US010161014B2

(12) United States Patent
Kopmanis

(10) Patent No.: US 10,161,014 B2
(45) Date of Patent: Dec. 25, 2018

(54) LASER HARDENED CRANKSHAFT

(71) Applicant: FORD MOTOR COMPANY, Dearborn, MI (US)

(72) Inventor: Michael A. Kopmanis, Monroe, MI (US)

(73) Assignee: FORD MOTOR COMPANY, Dearborn, MI (US)

( * ) Notice: Subject to any disclaimer, the term of this patent is extended or adjusted under 35 U.S.C. 154(b) by 459 days.

(21) Appl. No.: 14/991,175

(22) Filed: Jan. 8, 2016

(65) Prior Publication Data

US 2017/0198368 A1 Jul. 13, 2017

(51) Int. Cl.

| | |
|---|---|
| ***C21D 1/06*** | (2006.01) |
| ***C21D 1/18*** | (2006.01) |
| ***C21D 9/30*** | (2006.01) |

(52) U.S. Cl.

CPC ..... *C21D 9/30* (2013.01); *C21D 1/06* (2013.01); *C21D 1/18* (2013.01)

(58) Field of Classification Search

None

See application file for complete search history.

(56) References Cited

U.S. PATENT DOCUMENTS

| | | | | |
|---|---|---|---|---|
| 3,108,913 | A | 10/1963 | Sommer | |
| 3,257,865 | A | 6/1966 | Seulen et al. | |
| 3,313,016 | A | 4/1967 | Seulen et al. | |
| 3,824,659 | A | 7/1974 | Sommer | |
| 4,043,847 | A | 8/1977 | Just | |
| 4,652,724 | A | 3/1987 | Morita et al. | |
| 5,333,480 | A * | 8/1994 | Berstein | B21D 3/02 72/110 |
| 6,095,956 | A | 8/2000 | Huang | |
| 6,203,633 | B1 * | 3/2001 | Clauer | C21D 1/00 148/565 |
| 6,393,885 | B1 | 5/2002 | Cadena | |
| 9,015,939 | B2 | 4/2015 | Reeb et al. | |
| 9,358,605 | B2 | 7/2016 | Junker | |
| 2002/0040619 | A1 | 4/2002 | Hatton | |
| 2004/0244529 | A1 | 12/2004 | Toplack | |

(Continued)

FOREIGN PATENT DOCUMENTS

| | | |
|---|---|---|
| DE | 969013 C | 4/1958 |
| DE | 2138599 A1 | 2/1973 |

(Continued)

OTHER PUBLICATIONS

Koehler, H. et al., Laser Reconditioning of crankshafts; From lab to application; ScienceDirect, Physics Procedia 5 (2010) 387-397; www.sciencedirect.com.

(Continued)

*Primary Examiner* — George Wyszomierski

(74) *Attorney, Agent, or Firm* — Marla Johnston; Brooks Kushman P.C.

(57) ABSTRACT

A method of crankshaft laser hardening includes grinding one or more surfaces of a green crankshaft to produce a green ground crankshaft and to define journal geometry thereon prior to hardening of the surfaces to avoid loss of compressive stresses associated with grinding a hardened crankshaft. The method also includes laser hardening the surfaces of the green ground crankshaft to induce compressive stresses.

17 Claims, 2 Drawing Sheets

(56) References Cited

U.S. PATENT DOCUMENTS

| | | | | |
|---|---|---|---|---|
| 2010/0107808 | A1 | 5/2010 | Alderton et al. | |
| 2014/0223707 | A1 | 8/2014 | Schreiber et al. | |
| 2014/0260787 | A1 | 9/2014 | Kumar et al. | |
| 2015/0074998 | A1* | 3/2015 | Maldaner | B23K 26/0066 29/888.08 |
| 2015/0211083 | A1 | 7/2015 | Gabilondo et al. | |
| 2015/0231710 | A1* | 8/2015 | Nagata | B23B 49/04 408/1 R |
| 2017/0198369 | A1 | 7/2017 | Tanaka et al. | |

FOREIGN PATENT DOCUMENTS

| | | | |
|---|---|---|---|
| DE | 2618041 | A1 | 11/1977 |
| DE | 3905551 | A1 | 8/1990 |
| EP | 0982408 | A2 | 3/2000 |
| EP | 2463391 | A1 | 6/2012 |
| GB | 551901 | A | 3/1943 |
| GB | 2497564 | A | 6/2013 |
| JP | S59069516 | A | 4/1984 |
| JP | S59150016 | A | 8/1984 |
| JP | S60234169 | A | 11/1985 |
| JP | 2015227707 | | 12/2015 |
| WO | 2014/037281 | A2 | 3/2014 |

OTHER PUBLICATIONS

European Search Report dated Oct. 11, 2017 for related EP Application No. 17172588.0.

* cited by examiner

LASER HARDENED CRANKSHAFT

TECHNICAL FIELD

The disclosure relates to crankshaft and camshaft manufacturing including laser hardening of journal, lobe, and oil seal surfaces of a green ground crankshaft or camshaft.

BACKGROUND

Crankshaft and camshaft manufacturing includes a number of steps. Due to the nature of these shafts and the multiple processes required during their manufacturing, a relatively long work stream of up to 25 operations is required for high volume manufacturing, which in turn limits productivity. Additionally, a crankshaft or camshaft manufacturing process typically includes heat treatment followed by grinding and finishing. This sequence may result in a number of undesirable events such as a loss of compressive stress during the grinding operation, necking on journals, or insufficient percentage of the hardened surface area.

SUMMARY

A method of crankshaft hardening is disclosed. The method may include grinding surfaces of a green crankshaft to produce a green ground crankshaft and to define journal geometry thereon prior to hardening of the surfaces to avoid loss of compressive stresses associated with grinding of a hardened crankshaft. The method may further include laser hardening the surfaces of the green ground crankshaft to induce compressive stresses. The surfaces include a surface on a main journal, a pin journal, an oil seal, or a running surface. The hardened depth of the surfaces is 0.15 mm or more. The surfaces may include at least 85% surface area of a journal. The surfaces may include hardening of an area adjacent to an oil hole with no metallurgical transformation of the oil hole surface area. The area may be free of necking.

In another embodiment, a method of hardening a shaft is disclosed. The method may include grinding surfaces of a green shaft to produce a green ground shaft prior to hardening of the surfaces to avoid loss of compressive stresses associated with grinding after hardening; generating a surface hardening pattern from a 3-D model of the green ground shaft; and laser hardening the surfaces according to the surface hardening pattern to obtain a hardened ground shaft and to induce compressive stresses. The shaft may be a crankshaft or a camshaft. The surface hardening pattern may cover surfaces on one or more journals, lobes, oil seals, or running surfaces. The one or more journals may comprise a main journal or a pin journal. The hardened depth of the surfaces may be from 0.15 mm to 0.2 mm. The surface hardening pattern may cover at least 85% surface area of a journal. The surface hardening pattern may cover an area immediately adjacent to an oil hole and/or an undercut. The area may be free of necking.

In yet another embodiment, a method of soft shaft hardening is disclosed. The method may include grinding surfaces of a soft camshaft or soft crankshaft to produce a soft ground shaft to prevent inducement of tensile stresses associated with grinding of a hardened shaft; and laser hardening the surfaces of the soft ground shaft to create laser hardened surfaces that are free of necking and to induce compressive stresses. The surfaces may include at least one surface on a main journal, a pin journal, an oil seal, a lobe, or one or more running surfaces. The one or more running surfaces may comprise a bushing surface or a shouldered wall surface. The hardened depth of the surfaces may be 0.15 mm or more. The surfaces may include at least 85% surface area of a main journal. The surfaces may include an area immediately adjacent to an undercut on a main journal or a pin journal with no metallurgical transformation of the undercut.

DETAILED DESCRIPTION

Embodiments of the present disclosure are described herein. It is to be understood, however, that the disclosed embodiments are merely examples, and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Except where expressly indicated, all numerical quantities in this description indicating dimensions or material properties are to be understood as modified by the word "about" in describing the broadest scope of the present disclosure.

The first definition of an acronym or other abbreviation applies to all subsequent uses herein of the same abbreviation and applies mutatis mutandis to normal grammatical variations of the initially defined abbreviation. Unless expressly stated to the contrary, measurement of a property is determined by the same technique as previously or later referenced for the same property.

Figure 1:
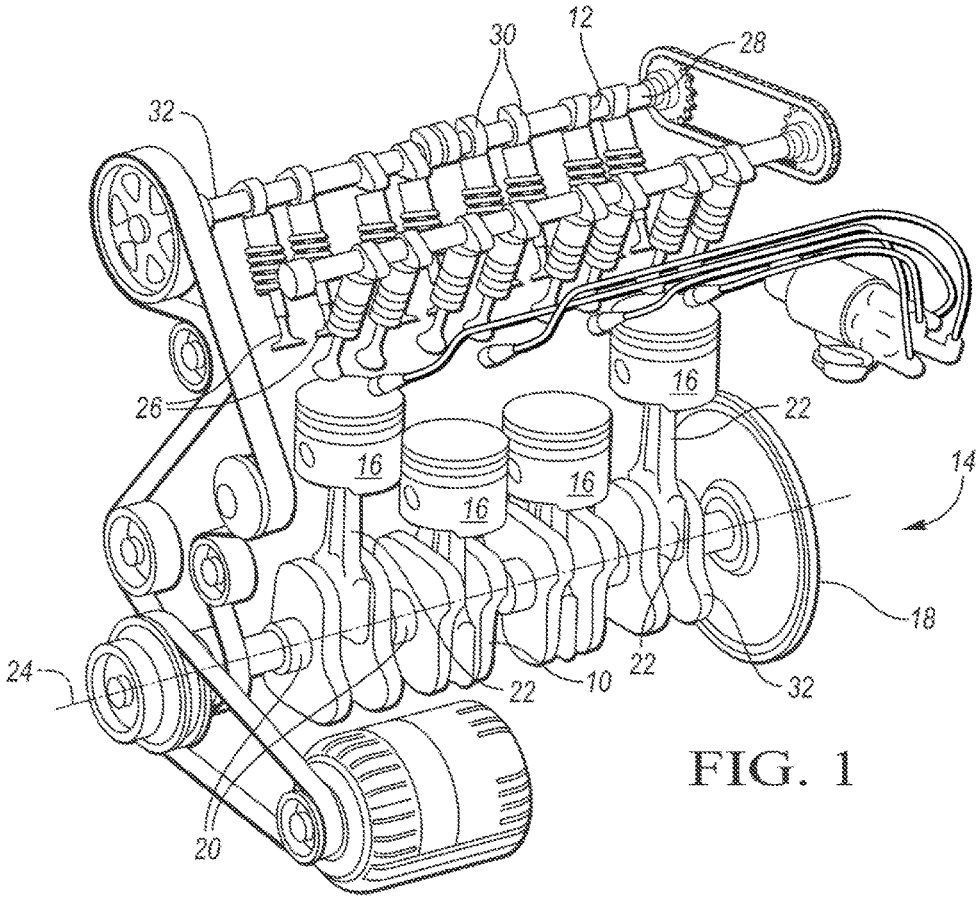
FIG. 1 depicts a schematic view of an exemplary vehicle combustion engine including a crankshaft and a camshaft in accordance with one or more embodiments.

Crankshafts and camshafts are fundamental features in an automotive engine. FIG. 1 depicts a schematic view of an exemplary crankshaft 10 and camshaft 12 as internal portions of a combustion engine 14. A crankshaft 10 is a mechanical part able to perform a conversion between reciprocating motion and rotational motion. In an internal combustion engine 14 of a vehicle, a crankshaft 10 translates reciprocating motion of the pistons 16 into rotational motion which enables the wheels to drive a vehicle forward. The crankshaft 10 may be any crankshaft 10 within the cylinder block or in the cylinder head. The crankshaft 10 is connected to a flywheel 18, an engine block (not depicted) using bearings on a number of main journals 20, and to the pistons 16 via their respective rods 22 so that all pistons 16 of an engine 14 are attached to the crankshaft 10. The crankshaft 10 regulates the movement of pistons 16 as it moves the pistons 16 up and down inside the cylinders (not depicted). The crankshaft 10 has a linear axis 24 about which it rotates, typically with several bearing journals 20 riding on replaceable bearings held in the engine block (not depicted).

FIG. 1 further illustrates an exemplary camshaft 12. The camshaft 12 may be any camshaft 12 within the cylinder block or in the cylinder head. A camshaft 12 is used to operate valves 26 of internal combustion engines with pistons 16. It consists of a cylindrical rod 28 running the length of the cylinder bank (not depicted) and a number of lobes 30 protruding from it, one for each valve 26. The lobes 30 force the valves 26 open by pressing on the valve 26 as they rotate. The camshaft 12 is linked to the crankshaft 10. As the crankshaft 10 rotates, the camshaft 12 rotates along with it in a synchronized movement.

Crankshafts 10 and camshafts 12 can be monolithic or assembled from several pieces. Typically, these shafts 32 are forged from a steel bar through roll forging or casting in iron. The manufacturing process includes a number of steps, typically up to 25 operations including rough machining of the crankshaft, hardening, grinding or turning, and polishing. Most steel shafts 32 have induction hardened journal surfaces. Some high volume automotive and most high performance shafts use a more costly nitride process. Carburization and flame hardening are other exemplary methods of hardening. Yet, all of these technologies present a number of disadvantages.

Induction hardening process has inherent drawbacks with respect to journal surface area coverage. The current flow around oil holes during the induction hardening process causes bulging and necking conditions. Additionally, axial locating of inductors is often problematic. Coils and recipes must be designed to prevent both metallurgical damage in the chamfer area and prevent pattern infringement into undercuts. These factors typically result in compromises with respect to hardness and surface coverage. To obtain a higher percentage of surface coverage, a change in the journal design to a tangential journal design has been proposed. Yet, the design change still results in additional manufacturing compromises related to grinding and polishing.

Typical processing of crankshafts and camshafts requires that the metal cutting be performed in two steps: roughing and finishing operations. Roughing is generally performed via turning or milling. Finishing is typically performed by grinding to achieve the required surface finish, size, and geometric profile. Finishing without first roughing the surfaces is not possible due to productivity and the level of material removal which would otherwise prevent the finishing process capability to meet tolerances.

The typical case hardening methods induce distortion of the shaft to such a degree that the process has to be applied prior to finishing. Typically, induction hardening causes 50 to 70 μm distortion in the shaft axis. Therefore, it is customary that the amount of material removed in the finishing operation and process positioning errors be accounted for and added to the desired finish case depth. This requires that the hardening case depth be increased. With the induction method, it can be accomplished via increasing heat time and power supply frequency.

Additionally, the finishing process results in a relative increase in residual tensile stresses. To avoid tensile stresses, lower productivity grind cycles must be employed. To measure absolute stress, costly and time-consuming X-Ray diffraction must be utilized. Despite these efforts, the grind-harden sequence always results in some loss of desirable compressive stress. Compressive residual stress in the journal surfaces helps prevent cracks from forming and is generally good for fatigue properties.

The typical hardening methods present additional drawbacks. For example, coils are used for induction hardening. These copper coils have to be changed anytime a new geometry on a journal is introduced. Such change is very costly and time consuming. Furthermore, a quench fluid and high electromagnetic field used during induction hardening present environmental and health challenges.

Nitriding has a number of disadvantages as well. For example, it is a relatively time consuming process, taking at least 8 hours. Additionally, the resulting depth of the hardened surface is relatively shallow, about 0.010-0.015 mm after a minimum of an 8-hour-long process, and the shaft has to be retreated if it is ever reground for service. While the nitriding case depth is limited to about 0.5 mm, the time to achieve this depth is about 120 hours which renders this method impractical for high volume applications. Nitriding also produces an undesirable white layer on the surface of the shaft. The layer typically requires removal by polishing of the surface after processing.

Therefore, it may be desirable to provide a method of shaft surface hardening which would overcome one or more limitations of the previously devised manufacturing methods. It would be desirable to provide a low-distortion hardening method which would offer greater capability of pattern positioning, increase overall hardened journal surface area, allow for wider hardened pattern of journal surfaces, and eliminate necking as well as the need to grind out the distortions which occur during the induction hardening process. Additionally, it would be desirable to develop a hardening method which would eliminate the soft zone around the oil hole on a journal. Additionally still, it would be desirable to provide a hardening method which would result in cost and time savings, eliminate the need for finish grind stock from the total case depth, eliminate copper coil tooling, and increase environmental safety by eliminating quench fluid and high electromagnetic field.

According to one or more embodiments, a method is provided which includes grinding one or more surfaces 34 of a green shaft 32" before the surfaces 34 of the green shaft 32" are hardened by laser. The green shaft 32" may be a green crankshaft 10" or a green camshaft 12". The method may include one or more steps. The steps may be repeated as needed. The term "green" shaft relates to soft state processing. The grinding operation is thus performed on a soft shaft 32" before the shaft is hardened. The grinding operation defines the geometry such as journal contours. The grinding operation may be performed on a green shaft 32" manufactured by casting, forging, or machining. Known methods and equipment may be used for the grinding operation. Since grinding is performed prior to hardening, there is no loss of desirable compressive stress, as is typical in shafts which are ground after hardening. Additionally, grinding of the green shaft 32" ensures that tensile stresses are less likely to develop in the shaft.

The green shaft 32" after the grinding operation is called a green ground shaft 32' or a ground soft shaft 32'. The green ground shaft 32' may be a green ground crankshaft 10' or a green ground camshaft 12'. The green ground shaft 32' may be washed to ensure that any chips, oil, or other impurities remaining on the surface after the grinding operation are removed prior to hardening. Washing may be performed by any known method and equipment such as by spraying, immersion in a bath, utilizing a chamber washer, or the like. The method may include a step of drying the green ground shaft 32' after washing.

Figure 2:
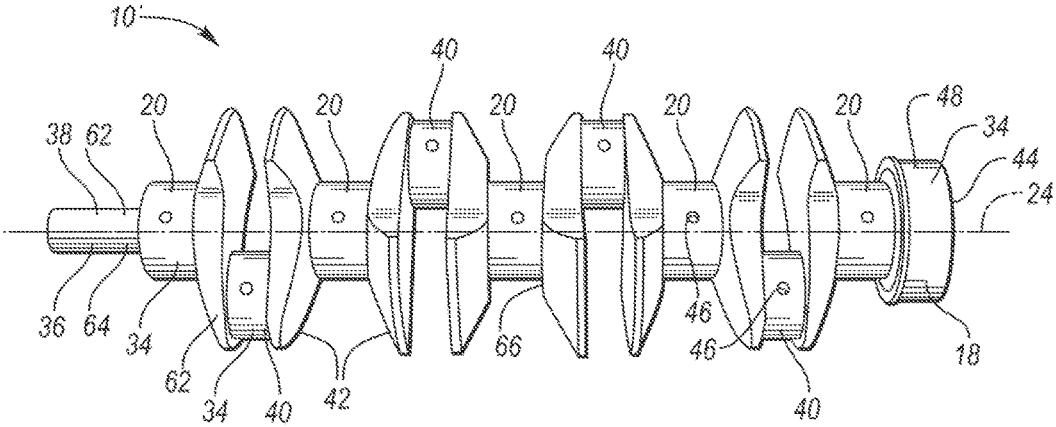
FIG. 2 depicts a perspective front view of an exemplary green ground crankshaft to be laser hardened.
Figure 3:
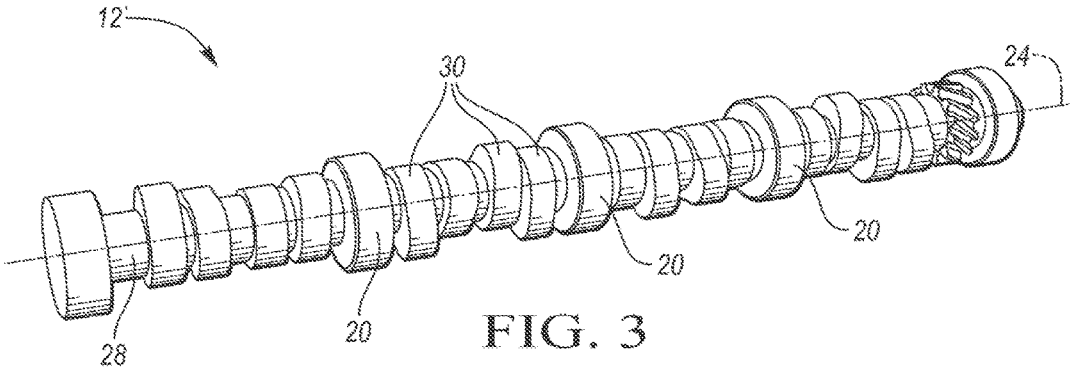
FIG. 3 depicts a perspective front view of an exemplary green ground camshaft to be laser hardened.

FIGS. 2 and 3 depict non-limiting detailed examples of a green ground crankshaft 10' and a green ground camshaft 12', respectively. Each shaft includes one or more surfaces 34 to be hardened. FIG. 2 depicts an exemplary green ground crankshaft 10' having a post 36 at the first end 38, main journals 20, and pin journals 40 connecting counterweights or bearings 42, and a flywheel 18 at the second end 44. The main journals 20, also called the main bearing journals or fillets, include an oil hole 46 which serves for distribution of lubricating oil to the bearings. The pin journals 40, also known as crankpins or crankpin fillets, also include an oil hole 46. The green ground crankshaft 10' further includes oil ducts facilitating lubrication, which are not depicted. The green ground crankshaft 10' may further include an oil seal 48 located on the flywheel 18. FIG. 3 depicts a non-limiting example of a green ground camshaft 12' having a cylindrical rod 28, a plurality of main journals 20, and a plurality of lobes 30.

The one or more surfaces 34 of the green ground shaft 32' to be hardened may include a surface on a main journal 20, a pin journal 40, an oil seal 48, or a lobe 30. The number of main journals 20, pin journals 40, oil seals 48, lobes 30, and their respective surfaces to be hardened may differ and depend on the desirable parameters of the shaft 32 which is being manufactured. In one or more exemplary embodiments, at least a portion of each main journal 20, a pin journal 40, an oil seal 48, a lobe 30, and/or a running surface 62 of a green shaft 32" is ground prior to hardening. A running surface 62 may be any cylindrical or shouldered surface or any surface in contact with a journal such as a bushing surface 64 or a shouldered wall surface 66.

The method may further include a step of generating a surface hardening pattern from a 3-D model of the green ground shaft 32' to be laser hardened prior to the laser hardening. The method may include a step of programming a microprocessor unit (MPU) to generate the surface hardening pattern. In one or more embodiments, the generated surface hardening pattern may include a series of preselected points, a portion of, or the entire surface geometry of the green ground shaft 32'. The surface hardening pattern may include one or more surfaces 34 on one or more main journals 20, pin journals 40, lobes 30, oil seals 48, or running surfaces 62.

In one or more embodiments, the method includes a step of laser hardening the green ground shaft 32' after grinding, washing, and/or drying to create the desirable compressive stress in the green ground shaft 32'. The method may include determining dimensions of the surface area to be hardened. The method may include a step of adjusting a spot size of the laser beam according to the dimensions of the surface are to be hardened. The method may include a step of directing a laser beam from the laser power unit to the surface 34 of the green ground shaft 32' to be hardened according to the surface hardening pattern. The method may include adjusting the pattern, the laser surface hardening pattern, and/or one or more parameters before, after, or during the hardening operation.

In one or more embodiments, the laser hardening may be facilitated by at least one laser power unit. A plurality of laser power units may be utilized. For example, one laser power unit may be used for tempering the surfaces 34 to be hardened. Such laser could be a lower power laser such as a 1.0 kW laser. The second laser power unit could be a high power laser unit facilitating the hardening. The high power unit could be, for example, a 6.0 kW laser. A laser power unit having a different power may be used, for example any laser having power ranging from 500 W to 50 W may be suitable. Alternatively, both tempering and hardening may be facilitated by one laser power unit. Alternatively still, tempering may be omitted. The temperature to be achieved during the hardening process should not exceed about 1260° C. to prevent overheating of the shaft material. Since overheating is not present, no quench fluid is needed during the method of the present disclosure.

The method contemplates using different types of lasers as the heat source for the hardening operation. Exemplary non-limiting examples of suitable lasers include lasers having different types of active gain media. The gain media may include liquid such as dye lasers in which the chemical make-up of the dye determines the operational wavelength. The liquids may be organic chemical solvent such as methanol, ethanol, and ethylene glycol containing a dye such as coumarin, rhodamine, and fluorescein. The gain media may include gas such as $CO_2$, Ar, Kr, and/or gas mixtures such as He—Ne. The gain medium may be metal vapor such as Cu, HeCd, HeHg, HeSe, HeAg, or Au. The gain media may include solids such as crystals and glass, usually doped with an impurity such as Cr, Nd, Er, or Ti ions. The solid crystals may include YAG (yttrium aluminum garnet), YLF (yttrium lithium fluoride), LiSAF (lithium strontium aluminum fluoride), or sapphire (aluminum oxide). Non-limiting examples of solid-state gain media doped with an impurity include Nd:YAG, Cr:sapphire, Cr:LiSAF, Er:YLF, Nd:glass, or Er:glass. The gain medium may include semiconductors having a uniform dopant distribution or a material with differing dopant levels in which the movement of electrons causes laser action. Non-limiting examples of semiconductor gain media may include InGaAs, GaN, InGaN, and InGaAsP. The laser may be a high power fiber laser created from active optical fibers doped with rare earth ions and semiconductor diodes as the light source to pump the active fibers.

The at least one laser power unit may be connected to the MPU also known as a central processing unit capable of accepting digital data as input, processing the data according to instructions stored in its memory, and providing output. The MPU may include mathematical modeling software which is capable of processing input data. Exemplary input data may include information about a 3-D model of a green ground shaft 32' having surfaces 34 to be hardened; parameters for new geometry such as hardening width, energy balance, or the like; parameters relating to oil holes such as the oil hole radius, offset from the center of a journal, or the like.

Due to the flexibility of the laser technology, the method may include hardening of a portion or the entire surface area of a surface 34 to be hardened. The method may include hardening about 85-100% surface area of the surface 34 to be hardened such as about 85-100% surface area of a main journal 20, a pin journal 40, a lobe 30, an oil seal 48, or a running surface 62. The laser hardening may include hardening of the one or more surfaces in a surface hardening pattern covering up to 100% surface area of the one or more surfaces 34. In comparison, a green crankshaft hardened prior to grinding may include only up to 75-85% of hardened surface area since induction hardening and other prior art methods named above are not capable of hardening a larger surface area. Specifically, clamshell induction hardening may achieve hardening of only up to 75% surface area and orbital induction hardening up to 85% surface area.

Figure 4:
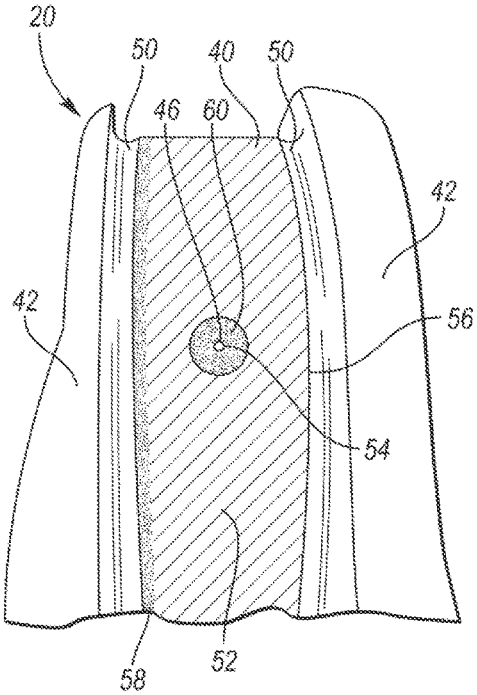
FIG. 4 depicts a perspective view of a portion of the crankshaft depicted in FIG. 2.

The method may include hardening of an area immediately adjacent to the oil hole 46 and/or the undercut 50. As FIG. 4 illustrates, the laser hardened journal 40 of a laser hardened shaft 32 may include a hardened surface area 52 directly adjacent to the edge 54 of the oil hole 46 and/or adjacent to the edge 56 of the undercut 50 with no metallurgical transformation of the oil hole 46 and/or the undercut 50. Alternatively, as can be seen in in FIG. 4, the laser hardened journal 40 may include a non-hardened surface of up to 0.5 mm from the undercut 50. The surface area of the oil hole 46 remains completely unhardened 60.

Figure 5:
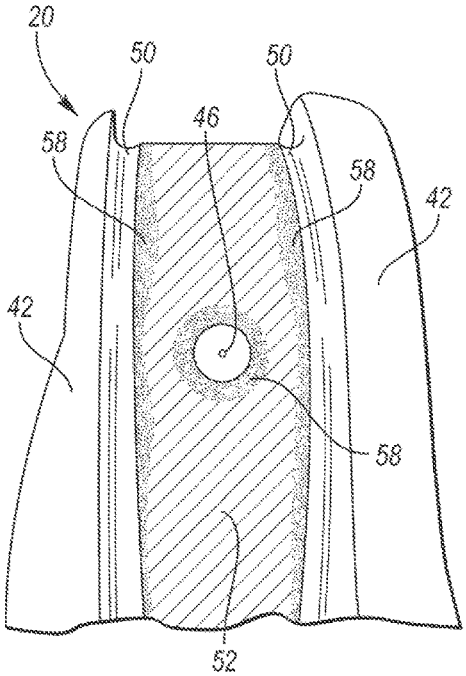
FIG. 5 (PRIOR ART)
FIG. 5 depicts a perspective view of a portion of a prior art crankshaft having induction hardened surfaces.

The method thus includes hardening of up to 100% surface area which is to be hardened. In contrast to the current disclosure, the area immediately adjacent the oil hole 46 or the undercut 50 on a green crankshaft hardened prior to grinding cannot be hardened and remains soft. This is illustrated in FIG. 5 in which a portion of an induction hardened crankshaft 10 before grinding is depicted. The crankshaft has counterweights 42 connected to a pin journal 40. The hardened surface area 52 on the pin journal 40 does not include the area adjacent to the oil hole 46 and to the undercuts 50. The pin journal 40 of FIG. 5 thus includes a non-hardened area 58 which remains soft. The dimensions of the soft area 58 around the oil hole 46 may reach up to 2-3 mm radially around the oil hole 46. The soft area 58 contributes to undesirable fatigue stress. Additionally, induction hardening of the area adjacent to the oil hole 46 presents other challenges such as difficulty in preventing overheating of the cross sectional area of the oil hole 46. Such overheating contributes to quench cracking and metallurgical damage which in turn affects fatigue strength. Adjusting the induction hardening process to alleviate overheating would in turn result in a compromised level of hardness or soft spots 58. Additionally, traditional induction hardening may affect the surface area of the oil hole 46 and/or the area of the undercut 50 such that the area 46 and/or 50 is heat affected and subjected to undesirable metallurgical changes.

Additionally, laser hardening eliminates necking. Necking is a narrowing of the induction pattern as the current flows around the oil hole 46 and/or the undercut 50. Necking is illustrated on a clamshell induction hardened journal 40 of FIG. 5. The absence of ferrous volume around the oil hole 46 and undercuts 50 results in higher current flow, resulting in bulging of the pattern at the oil hole 46 and around the undercuts 50. To avoid necking, induction coil design and/or the amount of current has to be adjusted as necking presents a fatigue stress concern. Yet, when the coil design and/or current are reduced, the area near the oil hole 46 and undercuts 50 results in a narrower, necked, pattern.

The method may include a step of hardening a surface 34 of a green ground shaft 32' to a depth of up to about 1.2-1.3 mm. Shallower case depth may be desirable and is contemplated as laser hardening provides desirable results at shallower depths while causing minimal distortion of the main journals 20. The distortion of the main journals 20 caused by laser hardening may be about 5 to 10 μm. In comparison, a green shaft hardened prior to grinding, such as an induction-hardened shaft, may feature about 50 to 70 μm distortion on the main journals 20. Therefore, the laser hardening process distortion levels are such that heat-related distortion is manageable when hardening is done post-grind. Laser hardened case depth can be reduced also because accounting for grinding stock to compensate for induction hardening distortions is no longer necessary. This in turn enables significantly shorter cycle time. Increasing scan speeds at the same or lower power levels can achieve hardening in a shorter time to deliver shallower case depths.

The method may include hardening a surface 34 to the case depth of about 0.05 mm to about 1.3 mm, about 0.15 mm to about 0.8 mm, about 0.2 mm to about 0.5 mm. Shallower hardening such as about 0.2 mm contributes to shorter cycle time. Laser hardening may save up to 50% of cycle time associated with hardening of a green crankshaft prior to grinding that requires a hardening depth of more than about 0.2 mm. Since such crankshaft will be ground after the hardening step, a relatively significant amount of stock material will be removed during the grinding procedure. Therefore, such shaft has to have a deeper case depth before the grinding operation begins which contributes to a longer cycle time. Unlike the prior art shafts, the laser hardened green ground shaft 32 of the present disclosure may be reground and/or remanufactured without repeating the hardening operation even if the case depth is only about 0.2 mm.

In one or more embodiments, the method may include additional manufacturing steps after the laser hardened green ground shaft 32 is laser hardened. In at least one embodiment, the method may include polishing. Polishing may include any conventional method of polishing of a metal surface of a laser hardened green ground shaft 32. The method may include removal of certain amount of material stock.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A method of crankshaft hardening comprising:

grinding surfaces of a green crankshaft to produce a green ground crankshaft and to define journal geometry thereon prior to hardening of the surfaces; and laser hardening the surfaces of the green ground crankshaft to induce compressive stresses, wherein a hardened depth of the surfaces is 0.15 mm or more.

2. The method of claim 1, wherein the surfaces include a surface on a main journal, a pin journal, an oil seal, or a running surface.

3. The method of claim 1, wherein the surfaces include at least 85% surface area of a journal.

4. The method of claim 1, wherein the surfaces include an area adjacent to an oil hole with no metallurgical transformation of the oil hole surface area.

5. The method of claim 4, wherein the area is free of necking.

6. A method of hardening a shaft comprising:

grinding surfaces of a green shaft to produce a green ground shaft prior to hardening of the surfaces;

generating a surface hardening pattern from a 3-D model of the green ground shaft; and laser hardening the surfaces according to the surface hardening pattern to obtain a hardened ground shaft and to induce compressive stresses, wherein a hardened depth of the surfaces is from 0.15 mm to 0.2 mm.

7. The method of claim 6, wherein the shaft is a crankshaft or a camshaft.

8. The method of claim 6, wherein the surface hardening pattern covers surfaces on one or more journals, lobes, oil seals, or running surfaces.

9. The method of claim 8, wherein the one or more journals comprise a main journal or a pin journal.

10. The method of claim 6, wherein the surface hardening pattern covers at least 85% surface area of a journal.

11. The method of claim 6, wherein the surface hardening pattern covers an area immediately adjacent to an oil hole and/or an undercut.

12. The method of claim 11, wherein the area is free of necking.

13. A method of soft shaft hardening comprising:

grinding surfaces of a soft camshaft or soft crankshaft to produce a soft ground shaft; and laser hardening the surfaces of the soft ground shaft to create laser hardened surfaces that are free of necking and to induce compressive stresses, wherein a hardened depth of the surfaces is 0.15 mm or more.

14. The method of claim 13, wherein the surfaces include at least one surface on a main journal, a pin journal, an oil seal, a lobe, or one or more running surfaces.

15. The method of claim 14, wherein the one or more running surfaces comprise a bushing surface or a shouldered wall surface.

16. The method of claim 13, wherein the surfaces include at least 85% surface area of a main journal.

17. The method of claim 13, wherein the surfaces include an area immediately adjacent to an undercut on a main journal or a pin journal with no metallurgical transformation of the undercut.

* * * * *